United States Patent [19]

Izumi et al.

[11] 4,454,020

[45] Jun. 12, 1984

[54] PROCESS FOR PRODUCING A HOMOGENEOUS LOW SOFTENING POINT, OPTICALLY ANISOTROPIC PITCH

[75] Inventors: Takayuki Izumi; Tsutomu Naito, both of Iruma; Seikoh Igarashi, Chiyoda, all of Japan

[73] Assignee: Toa Nenryo Kogyo Kabushiki Kaisha, Tokyo, Japan

[21] Appl. No.: 467,618

[22] Filed: Feb. 17, 1983

[30] Foreign Application Priority Data

Feb. 22, 1982 [JP] Japan ..... 57-27126

[51] Int. Cl.[3] ..... C01C 3/00; D01F 9/12; D01F 9/20

[52] U.S. Cl. ..... 208/22; 208/39; 208/44; 423/447.2

[58] Field of Search ..... 208/40, 22; 423/447.2, 423/447.4, 447.6; 264/29.2

[56] References Cited

U.S. PATENT DOCUMENTS

| | | | |
|---|---|---|---|
| 2,992,181 | 7/1961 | Renner | 208/22 |
| 3,976,729 | 8/1976 | Lewis et al. | 423/447.8 |
| 4,026,788 | 6/1977 | McHenry | 208/40 |
| 4,032,430 | 6/1977 | Lewis | 423/447.1 |
| 4,303,631 | 12/1981 | Lewis et al. | 423/447.4 |

*Primary Examiner*—Delbert E. Gantz
*Assistant Examiner*—Helane E. Maull
*Attorney, Agent, or Firm*—Joseph J. Dvorak

[57] ABSTRACT

A process for producing optically anisotropic pitch containing 80% or more of an anisotropic phase. A starting material is pyrolytically polycondensed. Afterward, the material is maintained at a temperature of between 350° and 400° C. to precipitate a portion of the material rich in the anisotropic phase having a high specific gravity. This portion is separated and further heat treated.

15 Claims, No Drawings

PROCESS FOR PRODUCING A HOMOGENEOUS LOW SOFTENING POINT, OPTICALLY ANISOTROPIC PITCH

FIELD OF THE INVENTION

The present invention relates to a process for the production of an optically anisotropic pitch, particularly, a homogeneous, low softening point, optically anisotropic pitch.

BACKGROUND OF THE INVENTION

Pitch is advantageous for producing carbon fibers or other high strength, high density molded carbon materials.

Optically anisotropic pitch compositions suitable for producing high performance carbon fibers are described in the specification of the previously filed Japanese Patent Application No. 162972/1980. As the result, it has now been found that an optically anisotropic pitch is a pitch having good molecular orientation with a developed laminate structure of fused polycyclic aromatics, but, in fact, it contains various kinds in mixture, among which, those having low softening points and suitable for the production of homogenous carbon fibers have specific chemical structures and compositions, that is, in the optically anisotropic pitch, the composition, structure and molecular weight of Component O, i.e. a component soluble in n-heptane and Component A, i.e. a component insoluble in n-heptane and soluble in benzene are extremely important. More specifically, it has been found that a pitch composition containing specific amounts of Component O and Component A can be present as an optically anisotropic pitch and that appropriate adjustment of the composition balance is an essential requirement on an optically anisotropic pitch composition for practically producing a high performance carbon fiber.

Further, it has also been found that by specifying the remaining components in the pitch composition other than the aforesaid Component O and Component A, that is, a component insoluble in benzene and soluble in quinoline (hereinafter referred to as Component B) and a composition insoluble in quinoline (hereinafter referred to as Component C), an optically anisotropic pitch for producing an even further excellent high performance carbon material may be provided.

Still further, as the result of the more detailed study in the respective characteristics of the aforesaid respective components and on the relationships between the contents of the respective components having said characteristics and the properties, homogeneity, orientation etc. of the total pitch, the present inventors have discovered it important that the respective components have specific properties. In other words, it has been discovered that for the properties of the constituting components of an optically anisotropic pitch having high orientation, homogeneity and a low softening point required for producing a high performance carbon fiber and capable of being melt spun stably at low temperatures, the C/H atomic ratio, the ratio of the carbon atoms in the aromatic structure to the total carbon atoms fa (hereinafter referred to as the fa or the aromatic carbon fraction), the number average molecular weight, the maximum molecular weight (the molecular weight at a point where 99% has been integrated from the lower molecular weight side) and the minimum molecular weight (the molecular weight at a point where 99% has been integrated from the higher molecular weight side) are specified within the ranges hereinbelow described.

SUMMARY OF THE INVENTION

The invention features a pitch comprising Component O having a C/H atomic ratio of about 1.3 or higher, an fa of about 0.80 or higher, a number average molecular weight of about 1,000 or less and a minimum molecular weight of about 150 or higher, and preferably that having a C/H atomic ratio of about 1.3–1.6, an fa of about 0.8–about 0.95, a number average molecular weight of about 250–about 700 and a minimum molecular weight of about 150 or higher.

Component A is that having a C/H atomic ratio of about 1.4 or higher, an fa of about 0.80 or higher, a number average molecular weight of about 2,000 or less and a maximum molecular weight of about 10,000 or less, and preferably that having a C/H atomic ratio of about 1.4–about 1.7, an fa of about 0.80–about 0.95, a number average molecular weight of about 400–about 1,000 and a maximum molecular weight of about 5,000 or less.

Suitable contents of the respective components are about 2% by weight to about 20% by weight of Component O and about 15% by weight to about 45% by weight of Component A. Further, the optimum range is such that Component O represents about 5% by weight to about 15% by weight and Component A represents about 15% by weight to about 35% by weight.

In other words, where the C/H atomic ratio and the fa of Component O are smaller than the aforesaid range or where the content is larger than the aforesaid range, the total pitch is apt to be a heterogeneous one containing a considerable proportion of the isotropic part. On the other hand, where the average molecular weight is larger than 700 or the content is smaller than the aforesaid range, a pitch having a low softening point is not obtainable. Where the C/H atomic ratio or the fa is smaller than the aforesaid range, if the number average molecular weight is smaller than the aforesaid range or the content exceeds the aforesaid range, the total pitch often tends to be a heterogeneous one having the isotropic and anistoropic parts in mixture. Where the number average molecular weight or the maximum molecular weight is larger than the aforesaid range, or where the constituting proportion of Compound A is smaller than the aforesaid ratio, the pitch will not be of a low softening point, although it may be homogeneous and optically anisotropic.

It has also been discovered that the aforesaid Component O and Component A are included in the laminate structure in the optically anisotropic pitch and exert a solvent-like or plasticiser-like action and hence influence the fusibility and fluidity of the pitch, or are components which do not easily manifest a laminate structure by themselves and hence do not exhibit optical anisotropy, but if the remaining components, i.e. the benzene insoluble Component B and Component C which do not melt and are easily laminated are contained in good proportion in the constitutional ratio to the aforesaid Component O and Component A within the specific range, and further if the chemical structure, characteristics and molecular weight of each constituting component fall within the specific ranges, an optically anisotropic pitch required for producing an even more excellent, high performance carbon fiber, homogeneous having a low softening point may be obtained.

In other words, it has been found that an optically anisotropic carbonaceous pitch which contains about 2% by weight–about 20% by weight of Component O, about 15% by weight–about 45% by weight of Component A, further about 5% by weight–about 40% by weight of Component B (the component insoluble in benzene and soluble in quinoline) and about 20% by weight–about 70% by weight of Component C (the component insoluble in both benzene and quinoline), which has a content of the optically anisotropic phase of about 90% or higher by volume, and which has a softening point of about 320° C. or below can provide a more stabilized high performance carbon fiber.

The aforesaid Component B and Component C are those in which the C/H atomic ratio, fa, number average molecular weight and maximum molecular weight (the molecular weight at a point where 99% has been integrated from the lower molecular weight side) are specified in the ranges hereinbelow described, so as to exhibit properties suitable for the constituting components of an optically anisotropic pitch having high orientation, homogeneity and a low softening point required for producing a high performance carbon fiber and capable of being melt spun stably at low temperatures.

That is, Component B (the component insoluble in benzene and soluble in quinoline) is that having a C/H atomic ratio of about 1.5 or higher, an fa of about 0.80 or higher, a number average molecular weight of about 2,000 or less and a maximum molecular weight of about 10,000 or less, and preferably that having a C/H atomic ratio of about 1.5–about 1.9, an fa of about 0.80–about 0.95 and a number average molecular weight of about 800–about 2,000 and Component C (the component insoluble in both benzene and quinoline) is that having a C/H atomic ratio of about 2.3 or less, an fa of about 0.85 or higher, an estimated number average molecular weight of about 3,000 or less and a maximum molecular weight of 30,000 or less, and preferably that having a C/H atomic ratio of about 1.8–about 2.3, an fa of about 0.85–about 0.95 and a number average molecular weight of about 1,500–about 3,000.

As regards the contents of both components, Component B should be about 5% by weight–about 55% by weight, preferably about 5% by weight–about 40% by weight, and Component C should be about 20% by weight–about 70% by weight, preferably about 25% by weight–about 65% by weight.

Heretofore, although several processes have been proposed for producing optically anisotropic carbonaceous pitches required for the production of high performance carbon fibers, any such process has failed to provide an optically anisotropic carbonaceous pitch suitable for producing high strength, high modulus carbon materials, which contains the Component O and Component A having the specific compositions, structures and molecular weights respectively as described above, and further Component B and Component C. Furthermore, these conventional processes also have various drawbacks, for example, (1) the starting materials are not easily industrially available; (2) they require a prolonged reaction or require complicated process steps, and hence the process cost is expensive; (3) if the optically anisotropic phase is made closer to 100%, the softening point is increased and hence spinning becomes difficult, whereas the softening point is depressed, resulting heterogeneity hampers spinning, and so forth.

DETAILED DESCRIPTION OF THE INVENTION

Generally speaking, the process described in Japanese Patent Publication No. 8634/1974 requires the use of a starting material expensive and difficult to obtain in a large amount, such as chrysene, anthracene, tetrabenzophenazine etc., or involves complicated production process steps of carbonizing a high temperature crude oil cracked tar and filtering off the infusibles at a high temperature, and even requires such high spinning temperature as 420°–440° C.

The process described in Japanese Patent Application Laid-open No. 118028/1975 is to use a high temperature crude oil cracked tar as a starting material and thermally polycondensing it with stirring, but in order to obtain a low softening point pitch, it requires a prolonged reaction and removal of the infusibles in the pitch by filtration at a high temperature.

Further, the invention of Japanese Patent Publication No. 7533/1978 discloses a process which comprises polycondensation of petroleum tar, pitch etc. using a Lewis acid type catalyst such as aluminum chloride, but it requires removal of the catalyst and heat treatment steps before and after the removal step, and therefore it inevitably becomes complicated and its operational cost is expensive.

The process described in Japanese Patent Application Laid-open No. 89635/1975 is that using an optically isotropic pitch as a starting material, and when thermally polymerizing it, conducting the reaction under reduced pressure or while blowing an inert gas into the liquid phase until the content of an optically anisotropic phase reaches 40–90%, but the pitch thus obtained is a pitch in which the quinoline insoluble and pyridine insoluble contents are equal to the content of the optically anisotropic phase.

Japanese Patent Application Laid-open No. 55625/1979 discloses an optical anisotropic carbonaceous pitch in which the optical anisotropic phase represents essentially completely 100%, but this pitch has considerably high softening point and spinning temperature, and the starting material is not specified more than that a certain commercially available petroleum pitch is employed, and when various kinds of starting materials, for example, coal tar, petroleum distillation residual oil etc., are employed in the production of pitch according to this process, the molecular weight is too large, and spinning would be impossible by the formation of infusibles or the increase in the softening point and spinning temperature.

Thus, none of the previously proposed processes for producing optically anisotropic carbonaceous pitches specified the composition or structure of the starting material, and therefore, the present situation is such that they cannot stably provide a predetermined high quality carbonaceous pitch.

In other ways, among the conventional techniques, those disclosed in Japanese Patent Application Laid-open Nos. 160427/1979, 58287/1980, 144087/1980, 2388/1981 and 57881/1981 are processes which comprise extracting an optically isotropic pitch or a pitch containing only a small proportion of an optically anisotropic phase with a solvent, thereby concentrating only the component which easily tends to form the optically anisotropic phase, but none of these has made clear moval of the volatiles. Then, the present inventors have studied on the relationship between the characteristics of the starting material and the characteristics of the pitch in order to obtain an optically anisotropic carbonaceous pitch suitable for the production of high strength, high modulus carbon materials, which contains the Component O and Component A having the specific compositions, structures and molecular weights as described above, and further Component B and Component C. In the above study, various starting pitch-like materials the main components of which are obtained from petroleum and coal and have a boiling point of about 540° C. or higher were employed. Each starting pitch-like material was fractionated into the aforesaid Component O, Component A, Component B and Component C using solvents as with the case of the product pitch.

In the above classification of the boiling point ranges of the main components, the class of "that of 540° C. or higher" means not only the boiling point range of the distillation residual oil of the heavy oil obtained by the distillation operation easily operative using a large-scaled distillation apparatus commonly employed in the petroleum and coal industry, but also the boiling point range of the active components effectively convertible into a pitch by the thermal reaction.

The pitch constituting components of the present invention, namely, Component O, Component A, Component B and Component C, are defined respectively as follows: A powder pitch is placed in a cylindrical filter having an average pore diameter of 1$\mu$, and extracted with n-heptane using a Soxhlet extractor for 20 hours, and the component soluble in n-heptane is called Component O; thereafter that obtained by extracting with benzene for 20 hours, i.e. the component insoluble in n-heptane and soluble in benzene is called Component A; then that obtained by separating the benzene insolubles with a quinoline solvent by centrifugation (JIS K-2425), i.e. the component insoluble in benzene and soluble in quinoline, which is the so-called $\beta$-resin, is called Component B, and the component insoluble in quinoline is called Component C. Such classification of the constituting components may be conducted according to the method described in e.g. Sekiyu Gakkai-shi, (Journal of Japan Petroleum Institute) Vol. 20 (1), 45 (1977).

As the result of the detailed study on the relationships of the constitutional ratio of the respective components of the thus fractionated starting pitch-like material, their respective molecular weights and aromatic structural characteristics with the properties, homogeneity and orientation of the product pitch obtained by a given process, and further with the performance of the carbon material produced therefrom, it has been discovered that for the starting material for an optically anisotropic pitch suitable for the production of high performance carbon fibers, which is highly orientated, homogeneous, has a low softening point and is capable of being stably melt spun at low temperatures, even though various processing methods and production process steps are employed, it is important that the aromatic carbon fraction fa of the above constituting components of the starting pitch-like material is sufficiently large and each number average molecular weight and each maximum molecular weight (the molecular weight at a point where 99% has been integrated from the lower molecular weight side) as measured by gel permeation chromatography are sufficiently small. The constituting components of the starting isotropic pitch-like material generally comprise the above-described Component O, Component A and Component B, and their contents are not particularly restricted in order to obtain the desired low softening point, optically anisotropic pitch. Furthermore, even when Component C, i.e. the component insoluble in quinoline, is contained, the desired homogeneous, optically anisotropic pitch having a high concentration of an optically anisotropic phase (hereinafter referred to as AP) could sometimes be obtained depending on the molecular weight and chemical structure of Component C, but Component C in the starting pitch-like material generally has unknown characteristics and contains solid carbons having a particle size of 1 or more and having an extremely high molecular weight, as well as metaphase in the so-called coal tar pitch, coke particles, rust, catalyst residue, inorganic solids etc., which adversely influence the final carbon product, and therefore, it is necessary to substantially exclude Component C in the starting material pitch stage that is to reduce it to 0.1% by weight or less, preferably not more than 100 ppm. If 0.1% by weight or more of Component C is contained in the starting pitch-like material, since most Component C is floating as solid particles in the fused pitch state, the starting pitchlike material substantially free from Component C may be obtained by filtering the fused starting material pitch at a temperature in the range of 100°-300° C.

Further, while the unknown Component C in the starting material pitch, i.e. metaphase, carbon particles, rust, catalyst residue, inorganic pulverulent particles, etc., may be sedimented and removed for the most part by allowing to stand in a storage tank at a temperature in the range of 100° C.-300° C. for a prolonged time, they may further be more positively removed, for example, such continuous removing method as a method which comprises maintaining the viscosity of the starting material pitch at 100 poise or less in the temperature range of 50° C.-300° C. and subjecting it to continuous centrifugal separation at $10^2$-$10^4$ G may be preferably employed.

Various pitch-like materials obtained from petroleum and coal contain, in addition to carbon and hydrogen, sulfur, nitrogen, oxygen, etc., and in the case where the starting material contains large amounts of such elements, since these elements cause cross-linking and an increase in viscosity in the thermal reaction and inhibit the lamination of the planes of the fused polycyclic aromatics, and as a result, a low softening point, homogeneous, optically anisotropic pitch is not easily obtained. Therefore, as the starting material for obtaining the desired optical anisotropic pitch, it is perferably a pitch-like material in which the main component elements are carbon and hydrogen and the total content of sulfur, nitrogen, oxygen, etc., is not more than 10% by weight, especially the content of sulfur being preferably not more than 2% by weight.

Furthermore, the starting material pitch according to the present invention is substantially free from quinoline insolubles, but generally contains chloroform insolubles, and the inclusion of this component does not interfere with the purpose of the present invention.

As the step for pyrolytic polycondensation, etc., on producing an optically anisotropic pitch from the above-described starting material, various processes described below may be employed.

Since the optically anisotropic pitch produced by the process of the present invention can be spun at a temwhat starting material to be used. Since there are extremely many kinds of optically isotropic pitches or pitches containing an optically anisotropic phase, it is believed that with each pitch, the characteristics greatly depend on the molecular weight distribution and fa of the starting material heavy oil, and that the results fluctuate, for example, the desired pitch is obtained in one case, but not in other case.

Furthermore, as disclosed in Japanese Patent Application Laid-open No. 57881/1981, the optically anisotropic pitch produced by either of such processes, although having a relatively narrow molecular weight distribution, generally has a high softening point, e.g. higher than 320° C. in most cases, and therefore the optimum temperature when spinning said pitch is often in the vicinity of 380° C. or higher at which the pyrolytic polycondensation and decomposition reaction of the pitch can occur, and as a result, where pitch fibers are to be mass-produced in an industrial scale, there is a possibility of a difficulty in the operation and quality control. Scientific reasons for this are that the optically anisotropic pitch in which the molecular weight distribution and the distribution of the aromatic structure have been adjusted by the solvent extraction, although can be adjusted so as to reduce the contents of the high molecular weight components, its low molecular weight components are excessively removed, thereby the components contributing to the fluidity in the produced optically anisotropic phase are reduced and as the result the softening point and spinning temperature of the optically anisotropic pitch are increased.

On the other hand, in the case where the optically anisotropic pitch is produced merely by pyrolytic polycondensation without using solvent extraction, for example, in the process disclosed in Japanese Patent Publication No. 1810/1979, although the molecular weight and structural characteristics of its starting material are not clarified, it is believed that since the pyrolytic polycondensation is conducted for a prolonged time while passing a large amount of an inert gas and simultaneously intensively accelerating the removal of the volatiles, the contents of lower molecular weight aromatic hydrocarbons in the produced optically anisotropic phase are reduced, and as a result, the produced optically anisotropic phase is essentially insoluble in quinoline and pyridine, and also its softening point and spinning temperature are relatively high.

As an approach to solve the problems of these prior art, the present inventors have developed a new technique as described in the specification of the previously filed Japanese Patent Application No. 11124/1981, which technique has enabled to give a homogeneous, low softening point, optically anisotropic pitch by using as a starting material an oily material chiefly comprising components having a boiling point in the range of 250°–540° C. and also having specific molecular weight and fa, and subjecting it to pyrolytic polycondensation and other necessary operations.

The present invention is a further development of the invention of Japanese Patent Application No. 11124/1981, and has been accomplished upon the discovery that by using a starting material having the aforesaid molecular weight and fa in the specific ranges, and subjecting it to pyrolytic polycondensation treatment to an appropriate extent, the above-described various drawbacks of the prior art can be improved, thereby a specific optical anisotropic pitch which enables the production of better quality carbon materials such as carbon fibers, graphite fibers, etc., can be produced stably in a high yield and at a low cost.

Accordingly, a primary object of the present invention is to provide a process for efficiently producing an optically anisotropic carbonaceous pitch suitable for producing high strength, high modulus carbon fibers.

Another object of the present invention is to provide a process for producing a homogeneous optically anisotropic carbonaceous pitch having a low softening temperature which enables stable spinning at adequately low temeratures, and excellent in molecular orientation.

A further object of the present invention is to provide a process for producing a novel optically anisotropic carbonaceous pitch having a specific molecular weight distribution among optically anisotropic carbonaceous pitches having specific compositions, by employing a pitch material chiefly comprising heavy hydrocarbons having specific molecular weight distributions and chemical structure constants.

The above-described and other objects of the present invention may be achieved by a process which comprises a step of subjecting a starting material to pyrolytic polycondensation which starting material is a pitch-like material which is a mixture chiefly comprising compounds consisting of carbon and hydrogen and having a boiling point of 540° C. or higher and is substantially free from quinoline insolubles, said starting material containing Component O, i.e. a component soluble in n-heptane, Component A, i.e. a component insoluble in n-heptane and soluble in benzene and, optionally, Component B, i.e. a component insoluble in benzene and soluble in quinoline, each aromatic carbon fraction (fa) of such components being 0.7 or higher, each number average molecular weight being 1,500 or less, and each maximum molecular weight being 10,000 or less.

Thus, according to the present invention, it is possible to produce a homogeneous, low softening point, optically anisotropic pitch which contains 80% or more, preferably 90–100%, of an optically anisotropic phase and has a softening point in the range of 320° C. or below, preferably 230°–320° C., and this is, as described above, suitable as carbon materials such as high quality carbon fibers, graphite fibers, etc.

The present invention is now more particularly described.

As described above, one of the causes for the problems involved in the prior art is that, although it is extremely important to select the starting material in order to produce an excellent pitch, the technique therefor is inadequate and such selection of the starting materials is not achieved that the development of the planar structural nature of the polycondensed nuclear aromatics and the gigantic growth of the molecules are kept in good balance in the pyrolytic polycondensation reaction. In other words, this is due to failure in selection of the starting material such that while the giantness of the molecules has not been so advanced and hence the softening point as its physical phenomenon is still adequately low, the planar structural nature has been well developed and therefore a substantially homogeneous, optically anisotropic pitch is produced.

Another cause for the problems relating to the prior art is that a process is employed which excessively removes low molecular weight components in the optically anisotropic phase. That is, this is due to the use of a pyrolytic polycondensation reaction which accompanies solvent extraction or a vigorous operation for reperature adequately lower than the temperature at which pyrolytic polycondensation is remarkable, the generation of decomposed gas during spinning is lessened, the polycondensation to heavier hydrocarbons is reduced, and the pitch is homogeneous, and therefore high-speed spinning is possible. Furthermore, when this optically anisotropic pitch is treated into a carbon fiber in conventional manner, it has been found that a carbon fiber of extremely high performance may be obtained.

The feature of the optically anisotropic pitch obtained by the present invention is that it satisfies all the three requirements, i.e. conditions required on the pitch for producing high performance carbon fibers: (1) high orientation (optical anisotropy), (2) homogeneity and (3) a low softening point (low spinning temperature).

The term "the optically anisotropic phase (AP)" is not always consistently employed in the academic field or in various technical publications, and therefore, in this specification, the optically anisotropic phase (hereinafter referred to AP) is defined as one of the pitch constituting components which is a part where, when the cross section of a pitch mass solidified at a temperature in the vicinity of room temperature is polished and observed under crossed Nicols of a reflecting polarizing microscope, brightness is exhibited by rotating the sample or the crossed Nicols, i.e. the optically anisotropic part, whereas the part where no brightness is exhibited, i.e. the optically isotropic part, is called an optically isotropic phase (hereinafter referred to as IP). Although the optically anisotropic phase may be considered the same as the so-called "mesophase", the "mesophase" consists of two kinds, i.e. one insoluble in quinoline or pyridine and the other containing a major proportion of a component soluble in quinoline or pyridine, and the optically anisotropic phase in this specification is mainly composed of the latter "mesophase", and in order to avoid confusion, this specification does not employ the term "mesophase".

The AP chiefly comprises molecules of a chemical structure in which planeness of the fused rings of polynuclear aromatics is more developed as compared with the IP, and they are agglomerated and associated in the form of laminate in plane, and it is believed that it takes a kind of liquid crystal state at a melting temperature. Therefore, when this is extruded from a thin spinneret and spun, the planes of the molecules take orientation more or less parallel to the direction of the fiber axis, and therefore, the carbon fiber produced from this optically anisotropic pitch exhibits high strength and modulus. Quantitative determination of the AP is conducted by observing it under crossed Nicols of a polarizing microscope, photographing and measuring the percent area represented by the AP part, and thus, this practically expresses the percent by volume.

As regards the homogeneity of the pitch, since in the present invention, that having about 80%–about 100% of an AP as the result of the above measurement, containing substantially no infusibles (of a particle size of 1μ or larger) detectable by microscopic observation of the pitch cross section, and substantially free from foaming due to volatiles at the melt spinning temperature, exhibits almost complete homogeneity in actual melt spinning, such is called a substantially homogeneous, optically anisotropic pitch. That having 70–80% of an AP sometimes possesses practically sufficient homogeneity on melt spinning, but in the case of a substantially heterogeneous optically anisotropic pitch containing about 30% or more of an IP, since this is clearly a mixture of a highly viscous optically anisotropic phase and a less viscous optically isotropic phase, spinning is conducted on the mixture of two pitch phases having remarkably different viscosities, and hence thread breakage frequency is increased, high speed spinning is difficult, that having an adequately small fiber thickness is not obtained and the fiber thickness fluctuates, and eventually, a carbon fiber of high performance cannot be obtained. Furthermore, on melt spinning, if the pitch contains infusible solid fine particles or low molecular weight volatile substances, not only spinnability is interfered but also the spun fiber inevitably contains voids and solid extraneous matters and gives cause for defects.

By the softening point of the pitch as referred to in this specification is meant the solid-liquid transition temperature of the pitch, and this is measured by the peak temperature of absorption and emission of the latent heat when the pitch melts or solidifies using a differential scanning calorimeter. This temperature agrees within the range of ±10° C. with those measured by such other methods as the ring and ball method, the micro melting point method, etc.

By the low softening point as referred to in this specification is meant the softening point in the range of about 320° C. or below, preferably from about 230° C. to about 320° C. The softening point has a close relationship with the melt spinning temperature of the pitch (the maximum temperature at which the pitch is melted and made flowable in a melt spinning apparatus), and in the case of spinning by a conventional method, a temperature higher by about 60° C.–about 100° C. is generally the temperature exhibiting a viscosity suitable for spinning (not necessarily the temperature at the spinneret). Accordingly, where a softening point is higher than about 320° C., since melt spinning is conducted at a temperature higher than about 380° C. at which pyrolytic polycondensation occurs, not only spinnability is interfered by the generation of decomposed gas and the formation infusibles, but also the spun pitch fiber contains voids and solid extraneous matters and gives cause for defects. On the other hand, where the softening point is lower than 230° C., the temperature for treatment to make infusible is such low temperature as 200° C. or below, and is not preferable, because it requires prolonged treatment or complicated and expensive treatment.

The meanings of the "fa," "number average molecular weight" and "maximum molecular weight" as used in this specification are more particularly explained.

The fa as referred to in this specification expresses the ratio of the carbon atoms in the aromatic structure to the total carbon atoms, as measured by the analysis of the carbon and hydrogen contents and the infrared absorption method. Since the planar structural nature of the molecules varies depending on the size of the fused polycyclic aromatics, the number of the naphthene rings, the number and lengths of the side-chains, etc., the planar structural nature may be considered using the fa as the index. That is, the larger the size of the fused polycyclic aromatics and the lesser the number of the naphthene rings and the shorter the side-chains, the greater the fa becomes. Therefore, it means that the greater the fa, the greater the planar structural nature of the molecules. Measurement and calculation of the fa employed are that according to the method by Kato (Kato et al., Nenryō Kyōkai-shi, Vol. 55, 244 (1976)) and calculated using the following equation:

$$fa = 1 - \frac{H/C}{2 \cdot \left(1 + 2 \cdot \frac{D_{3030}}{D_{2920}}\right)}$$

wherein

H/C: The atomic number ratio of hydrogen to carbon.

$D_{3030}/D_{2920}$: The ratio of the absorbance at 3030 $cm^{-1}$ to the absorbance at 2920 $cm^{-1}$.

The number average molecular weight as referred to in this specification is the value obtained by measuring by the vapor pressure equilibrium method using chloroform as a solvent. The molecular weight distribution was measured by fractionating the same origin sample into 10 fractions by gel permeation chromatography using chloroform as a solvent, measuring the number average molecular weights of the respective fractions by the vapor pressure equilibrium method, preparing a calibration curve therefrom as the molecular weight of the standard substance, and measuring the molecular weight distribution of the sample of the same series. The maximum molecular weight is expressed as the molecular weight at a point where 99% by weight has been integrated from the lower molecular weight side of the molecular weight distribution measured by the gel permeation chromatograph.

In general, since the pitch contains chloroform insolubles, the above-described molecular weight measurement cannot be used directly. Therefore, the molecular weight measurement of a pitch sample may be achieved as follows: Firstly, the above-described solvent fractionation analysis is conducted to obtain Components O, A, B and C respectively. Components O and A are each dissolved in a chloroform solvent, while Components B and C are each subjected to mild hydrogenation using metal lithium and ethylenediamine to convert to a chloroform soluble substance with hardly changing each molecular weight (this method being conducted according to the literature: Fuel, 41, 67–69 (1962)) and then dissolved in a chloroform solvent. Thereafter, as described above, the measurement of the number average molecular weight by the vapor pressure equilibrium method, the preparation of the gel permeation chromatograph calibration curve of the same origin pitch and the measurement on the molecular weight distribution graph are conducted.

The total molecular weight distribution and number average molecular weight of the entire pitch may be easily calculated from the contents of the respective Components O, A, B and C and their respective molecular weight distribution data.

With the three components constituting the starting pitch-like material, namely, Component O, Component A and Component B, their characteristic values, i.e., fa, number average molecular weight and maximum molecular weight, become larger in the order of Component B, Component A and Component O. In other words, among the three components, Component O is the one in which the planar structural nature of the molecules and the giantness of the molecules (the number average molecular weight and maximum molecular weight) are the smallest, Component A has the planar structural nature of the molecules and the giantness of the molecules somewhere between those of Component O and Component B, and Component B is a component whose planar structural nature of the molecules and giantness of the molecules are the greatest among these three components.

The relationship of the orientation, homogeneity (or compatibility) and softening point of the pitch for producing high performance carbon fibers with the molecular structure of the pitch is now explained.

The orientation of the pitch has something to do with the planar structural nature of the molecules and the liquid flowability at a given temperature. That is, that the planar structural nature of the pitch molecules in sufficiently large and that the liquid flowability is high enough for re-orienting the planes of the molecules in the direction of the fiber axis when melt spinning are the required conditions for a highly oriented pitch.

This planar structural nature of the molecules may be considered using the fa as the index, because the greater the polynuclear aromatics plane and the lesser the number of the naphthene rings and the lesser the number of the paraffin side-chains and the shorter the side-chains, then the greater the planar structural nature of the molecule. It is believed that the greater the fa becomes, the greater the planar structural nature of the pitch molecules becomes.

The liquid flowability at a given temperature depends on the degree of freedom of mutual movements between the molecules and between the atoms, and therefore, this may be evaluated using the giantness of the molecules, i.e. the number average molecular weight and molecular weight distribution (especially, the influence by the maximum molecular weight is believed great) as an index. In other words, if the fa is the same, it may be presumed that the smaller the molecular weight and maximum molecular weight, the greater the liquid flowability at a given temperature. Therefore, it is important for the high performance pitch that the fa is sufficiently large, the number average molecular weight and maximum molecular weight are sufficiently small and adequate distribution of relatively low molecular weights is present.

The homogeneity of the pitch (or compatibility of the pitch components) has something to do with similarity in chemical structure between the pitch molecules and the liquid flowability at a given temperature. Therefore, as with the case of orientation, the similarity of the chemical structures may be evaluated by representing by the planar structural nature of the molecules and using the fa as the index, and the liquid flowability may be evaluated using the number average molecular weight and maximum molecular weight as the index. In other words, it is important for the homogeneous pitch that the difference in fa between the pitch constituting components is adequately small, the number average molecular weight and maximum molecular weight are adequately small and the compositions and structures of the AP and IP are sufficiently similar.

Since the softening point means the solid-liquid transition temperature of the pitch, it has something to do with the degree of freedom of mutual movements of the molecules which dominate the liquid flowability at a given temperature, and may be evaluated using the giantness of the molecules, namely, the number average molecular weight and molecular weight distribution (especially, the influence by the maximum molecular weight is believed great) as the index. In other words, it is important for the pitch having a low softening point and hence a low melt spinning temperature that the number average molecular weight and maximum molecular weight are sufficiently small and adequate distribution of relatively low molecular weights is present.

Next, the relationship between the characteristics of the molecular structure of the starting material and the orientation, homogeneity (or compatibility) and softening point of the pitch is explained. What is most important on producing the desired optically anisotropic pitch by pyrolytic polycondensation of the starting material is that the planar structural nature of the molecules of the fused polycyclic aromatics and the giantness of the molecules are maintained in good balance during the reaction. In other words, in the course during which the thermal reaction proceeds, an optically anisotropic phase is produced and this further grows to a homogeneous, optically anisotropic pitch, it is important that the planar structural nature and liquid flowability of the entire pitch formed are sufficiently maintained. More specifically, it is important that the number average molecular weight and maximum molecular weight are still not so great when the thermal reaction has sufficiently proceeded and the plane structure of the aromatics has been sufficiently developed.

Therefore, for the above purpose, it is important for the starting material prior to the reaction such as pyrolytic polycondensation that the planar structural nature, i.e. fa of the molecules of the constituting components is sufficiently greater, and correspondingly, the number average molecular weight and maximum molecular weight of the constituting components are sufficiently small. In such a case, the average fa, number average molecular weight and maximum molecular weight of the total starting material do not necessarily give a good judgment on suitability as the starting material.

The reason for the above is that although continuity or similarity in molecular structure between the respective molecules is important, it cannot be judged from the average characteristic values. That is, even if the average fa is adequately large and the number average molecular weight is adequately small, there can be, for example, such a case where the fa of Component A is too small and the number average molecular weight of B Component is too large; such an unbalanced starting material would only give a heterogeneous pitch by the thermal reaction and thus fail to give the desired pitch.

Based on the above consideration, the present inventors have intensively studied on the compositions and structures of and the thermal reaction conditions for various pitch-like materials chiefly comprising components having boiling points of 540° C. or higher as well as the characteristics of the pitches produced therefrom, and, as a result, have discovered that, as described above, when each fa of the components constituting the starting material, i.e. Component O, Component A and Component B, is 0.7 or higher, preferably 0.75 or higher, each number average molecular weight is 1,500 or less, preferably 250–900 for Component O and Component A and 500–1,200 for Component B, and each maximum molecular weight is 10,000 or less, preferably 3,000 or less for Component O and Component A and 5,000 or less for Component B, then the fa of each constituting component of the starting pitch-like material is adequately large and each number average molecular weight and maximum molecular weight are adequately small, and similarity in molecular structure between the constituting components is not so wide apart. In other words, it has now been found that since the planar structural nature, liquid flowability and homogeneity of the molecules constituting the starting material are retained in good balance even after the subsequent reaction, a homogeneous, low softening point, optically anisotropic pitch may be obtained with good reproducibility from such a starting pitch-like material by the thermal reaction.

More specifically, even in the case where each number average molecular weight of Component O, Component A and Component B in the starting material pitch is 1,500 or less and each maximum molecular weight is 10,000 or less and thus both are adequately small, if the fa of at least one component among the respective components is smaller than 0.7, the balance between the planar structural nature of the constituting molecules and the liquid flowability of the molecules is lost and accordingly the reaction time required for the planar structural nature of the molecules to be adequately developed by the thermal reaction, i.e. the time necessary to the component having a small fa to become a pitch component having an adequately large fa by pyrolysis, is relatively long, and during that time, the molecular weight of the pitch tends to become too gigantic, and the softening point of the optically anisotropic part becomes higher.

Further, even if each fa of Component O, Component A and Component B in the starting material is 0.7 or higher, if the number average molecular weight of at least the component of the respective components exceeds 1,500 or the maximum molecular weight exceeds 10,000, gigantic pitch molecules having high molecular weights are acceleratingly formed by thermal polycondensation, and as a result, there is a tendency that an extremely heterogeneous pitch is formed or an optically anisotropic part having a high softening point is formed.

As the starting material for producing an optically anisotropic pitch, i.e. the so-called pitch-like material, there are various materials obtained as by-products from the petroleum industry, coal industry, etc. The constituting components of these starting pitch-like materials generally contain Component O, Component A and Component B, and sometimes further contain Component C.

Among the above, often Component C contained in the starting material befoe being subjected to the pitch production step is generally carbonacious matters having extremely large molecular weights, inorganic solid particles etc., and is not desirable for the purpose of the present invention, and therefore, it is preferred that this is substantially excluded, that is, its content is 0.1% by weight at most. Of course, when the starting material is subjected to the pyrolytic polycondensation step, Component C is inevitably formed from Component O, Component A and Component B, and therefore, the case where an intermediate product pitch which has already undergone the pyrolytic polycondensation step is to be employed as the starting material, Component C can and may be present, but the characteristics of Component C in such a case must be such that the fa and the molecular weight and molecular weight distribution are each continuous with those of the other components. In other words, the fa must be 0.85 or higher, the number average molecular weight must be in the range of 1,500–3,000 and the maximum molecular weight must be 30,000 or less.

The constitutional ratio of the contents of Component O, Component A and Component B in the starting material, as described above, is not the requisite for obtaining the desired low softening point, optically anisotropic pitch, and hence only the molecular structural characteristics of these components are the required condition; the constitutional ratio of the contents of the above three components may vary within a wide range, as long as the structural requirements are satisfied.

In usually available starting pitch-like materials, none is present which does not contain Component O or Component A, but those which do not contain Component B in an amount more than detectable, i.e. those substantially free from Component B, are present; even in the latter case, as long as the characteristics of Component O and Component A satisfy the above-described requirements, the desired low softening point, optically anisotropic pitch may be produced.

Furthermore, although not necessary, one of the above three components could be removed for the most part by a deliberate operation. Even in such a case, if the characteristics of the other components satisfy the above-described requirements, the desired low softening point, optically anisotropic pitch can be produced.

Generally, since the fa and the number average molecular weight and maximum molecular weight become larger in the order of Component B, Component A and Component O, it can be understood that the yield of the residual pitch by the same reaction manipulation becomes greater when the contents of Component A and Component B are larger, but its preferred constitutional ratio is not recognized.

As has been described in detail, by using the pitch-like material according to the present invention and having unique characteristics not disclosed in the prior art, an optically anisotropic pitch for carbon materials may be produced by various processes, and this is also one of the features of the present invention. More specifically, in the pyrolytic polycondensation step for producing an optically anisotropic pitch, any of the following processes serves the purpose of the present invention: a process which comprises conducting pyrolytic polycondensation in the temperature range of 380°–460° C., preferably 400°–440° C., under normal pressure while passing (or bubbling) an inert gas and simultaneously removing low molecular weight substances, a process which comprises conducting pyrolytic polycondensation under normal pressure without passing an inert gas and thereafter removing low molecular weight substances by heat treatment while simultaneously removing volatile matters by distillation under reduced pressure or with an inert gas, a process which comprises conducting pyrolytic polycondensation under elevated pressure and thereafter conducting heat treatment while simultaneously removing volatile matters by distillation under reduced pressure or with an inert gas, and so forth. In other words, the use of the starting material according to the present invention enables a wide selection of conditions for the pyrolytic polycondensation (temperature, time, degree of removal of the volatiles) and accurately permits the production of a homogeneous, low softening point, optically anisotropic pitch.

Further, in addition to the above-described process for producing an optically anisotropic pitch by the pyrolytic polycondensation along, a process which involves the separation of an optically anisotropic phase during the pyrolytic polycondensation reaction may be suitably adapted for the purpose of the present invention.

More specifically, since the above-described process effected only by the pyrolytic polycondensation reaction step gives an optically anisotropic pitch by the pyrolytic polycondensation along in substantially one reaction step, even an AP produced in an early stage is continuously kept at a high temperature until the end of the reaction, and accordingly, the molecular weight of the AP tends to become too gigantic and thus the softening point tends to somewhat increase even when the starting material system of the present invention is employed, whereas the process in which the optically anisotropic pitch is separated during the pyrolytic polycondensation can prevent excessive growth of the molecules and thus is more preferable in order to obtain a substantially homogeneous, low softening point, optically anisotropic pitch. In other words, a better effect can be achieved by a production process which comprises introducing as a starting material a pitch-like material having the characteristics described herein into a pyrolytic polycondensation reactor, conducting pyrolytic condensation at a temperature of 380°–460° C., then when the state reaches such that 20–70% of the AP is present in the produced pitch (substantially excluding the low molecular weight decomposed products and the unreacted reactants), allowing this polycondensed pitch to stand at a temperature of 350°–400° C., within which the pyrolytic polycondensation hardly proceeds and flowability of the pitch as a liquid is still sufficiently retained, for 30 minutes to 20 hours, allowing the AP part having a greater density to deposit in the lower layer as one continuous phase while growing and aging, and separating and withdrawing this from the upper layer phase having a smaller density, i.e., the optically isotropic pitch. Also in such a case, it is preferred to conduct the pyrolytic polycondensation reaction under elevated pressure of 2–200 kg/cm$^2$, then remove the volatile decomposed products, and thereafter allow the AP to deposit in the lower layer.

Furthermore, a process which comprises using a pitch-like material having the above-described characteristics according to the present invention as a starting material, subjecting said pitch-like material to pyrolytic polycondensation to partially produce an AP, allowing most of the AP to deposit at a temperature at which the increase in the molecular weight of the AP is depressed to obtain a pitch in which the AP has been concentrated, and thereafter subjecting it to heat treatment for a short time, thereby producing a finished pitch containing 90% or more of the AP and having a desired softening point is more preferred.

More specifically, the process preferably comprises using a pitch-like material having the characteristics described herein as a starting material, subjecting it to a pyrolytic polycondensation reaction at a temperature of about 380° C. or higher, preferably at 400°–440° C., then when the AP produced in the polycondensate reaches 20–70%, preferably 30–50%, allowing said polymer to stand or agitating or stirring it extremely slowly while maintaining the temperature at about 400° C. or lower, preferably 360°–380° C., for a relatively short time, for example, 5 minutes to 10 hours or so, thereby depositing the AP pitch part having a greater density in the lower layer in a high concentration, thereafter separating and withdrawing most of the lower layer having a higher concentration of the AP from the upper layer having a lower concentration of the AP, and finally further subjecting the thus separated lower layer pitch having an AP content of 70–90% to heat treatment is about 380° C. or higher, preferably 390°–440° C., for a short time, thereby obtaining a pitch having an AP content of 90% or higher, or even completely 100%, and a predetermined desired softening point.

In the above process, the step in which the starting pitch-like material undergoes the pyrolytic polycondensation is usually accompanied by removal of the volatiles by which low molecular weight substances produced by decomposition are removed outside the liquid pitch system, but especially in the case where a pitch containing 80% or more of the AP is to be produced by the pyrolytic polycondensation step along, if pass-through stripping under excessively reduced pressure for a prolonged time or at an excessively high flow rate of an inert gas for a prolonged time is employed, the yield of the produced pitch tends to reduce and also its softening point tends to increase. This is because since the degree of removal of the volatiles is too much, the low molecular weight component of the AP is unduly reduced. On the contrary, if stripping using an unduly low degree of vacuum or an unduly low flow rate of an inert gas is employed, since the decomposed products stay long in the reaction system and hence the AP production and its concentration require a longer time and also the polycondensation proceeds during that time, the molecular weight distribution is too extended, which tends to adversely affect the homogeneity and softening point of the final pitch. The degree of vacuum or the flow rate of an inert gas in the above-described pyrolytic polycondensation step should be appropriately selected according to the kind of the starting material, the shape of the reactor, the temperature and the reaction time, and thus this is rather difficult to restrict, but where the starting material of the present invention is employed at 380° C.–430° C., if conducted under reduced pressure, the final degree of vacuum of 1–50 mm Hg is suitable, and if an inert gas flow is employed, a range of 0.5–5.1 per min per kg of sample is suitable.

More specifically, where a reaction at a relatively low temperature range of 380° C.–400° C. for 10 hour or longer is required, if conducted under reduced pressure, the final degree of vacuum of 3–50 mm Hg is preferred, and if an inert gas flow is passed, 0.5–3 l/min/kg is preferred, or where the reaction is brought to termination in several hours by using a temperature of 410° C.–430° C., the final degree of vacuum of 1–2 mm Hg in the case of the reduced pressure mode and the flow rate of 2–5 l/min/kg in the inert gas flow mode are preferred.

Further, the above inert gas flow may be effected by bubbling the gas into the pitch, or it may also be effected by merely passing the gas over the liquid surface. In order to avoid cooling off of the reaction system liquid phase, it is preferred to heat the inert gas to be passed using a preliminary heater.

In addition, it is needless to say that agitation or stirring sufficient for uniformly reacting the reaction liquid phase is necessary. This agitation or stirring of the reaction liquid phase may also be effected while passing and bubbling a heated inert gas.

The inert gas may be any whose chemical reactivity is extremely small at the use temperature and whose vapor pressure is adequately large, and, for example, in addition to commonly employed argon, nitrogen, etc., steam, carbon dioxide, methane, ethane, or other low molecular weight hydrocarbons may be used.

Further, in the above-described process, in the step in which the pitch concentrated to 70–90% of the AP and having a sufficiently low softening point is further subjected to heat treatment conditioning thereby making the AP concentration 90% or higher and slightly increasing the softening point to the desired softening point, although it is not essential to pass an inert gas, this may of course be effected while simultaneously removing the volatiles by passing an inert gas similarly as in the above-described pyrolytic polycondensation step.

The optically anisotropic pitch produced according to the process of the present invention described above by employing a characteristic starting material, i.e., that wherein the molecular weights of the contained components are adequately small, wherein their distributions are narrow and wherein the aromatic structures of the molecules are well developed, behaves as a substantially homogeneous pitch in e.g. the spinning step even though it is not 100% complete AP, and in spite of the inclusion of 80% or more, generally 90% or more, of the AP, it has an extremely low softening point and therefore has a feature that a spinning temperature adequately low in practice may be applied.

The optically anisotropic pitch excellent in practice produced by the process of the present invention does not necessarily have the compositions and characteristics corresponding to those of the pitch materials, i.e., Components O, A, B and C, described in the specification of Japanese Patent Application No. 162972/1980; however, as the result of the investigation on the cause why the above excellent characteristics have been imparted, their specific molecular weight distributions were observed.

More specifically, as the result of the analysis of various optiocally anistropic pitches produced by the process of the present invention, it has been discovered that their number average molecular weights are in the range of about 900–1,500 and, although somewhat varying depending on the difference of the starting material and the production process, most fall within the range of about 1,000–1,100, and such are those having a great content of the AP, homogeneous and having an adequately low softening point.

Further surprisingly enough, where the AP is 90% or more, even in the case of nearly 100%, low molecular weight components having the AP of a molecular weight of 600 or less are contained in amounts of 30–60 molar %, and this is a great feature of the present invention.

This fact is believed as the results derived from the use of the starting material and production process according to the present invention, and it is thought that, as a result, the softening point of the AP is reduced and the flowability and moldability of the pitch are enhanced.

Further, it is a second feature that in the distribution of the high molecular weight components, molecules having a molecular weight of 1,500 or higher are contained as much as 15–35%. However, such are those whose maximum molecular weight (the number average molecular weight of a 1% by weight fraction from the higher molecular weight side) does not exceed about 30,000, and this also believed as the specific results derived from the use of the starting material and production process of the present invention, and it is believed that these high molecular weight components, which exist in the pitch, form a backbone structure contributing to the AP orientation and molding strength and accordingly enable spinning of thin and strong pitch fibers.

Furthermore, the remaining intermediate molecular weight components, i.e., those having a molecular weight of 600–1,500 in the case of the pitch of the present invention are present in the range of 20–50 molar %.

As has been described above, the optically anisotropic carbonaceous pitches produced by various processes according to the present invention by employing the starting material as described above are adequately homogeneous, optically anistropic pitches containing 80–100% of the AP and yet have a low softening point, and present the following advantages which have never been achieved by the prior art. That is, there are exerted such unexpected effects as: (1) that an optically anisotropic carbonaceous pitch virtually comprising a homogeneous AP and having a low softening point (e.g., 260° C.) may be obtained in a short time (for example, the total reaction of 3 hours) without the need of a complicated and costly step, such as high temperature filtration or solvent extraction of the infusibles, removal of the catalyst, etc., and thus that for producing a carbon fiber, a low maximum spinning temperature (the maximum temperature suitable for melt flowing and transferring the pitch in a melt spinning apparatus), i.e., 290°–370° C., generally 300°–360° C., may be employed; (2) that since the optically anisotropic pitch produced by the process of the present invention has excellent homogeneity and enables spinning of a fiber having a smooth surface and a uniform thickness at a temperature sufficiently lower than about 400° C. at which pyrolytic polycondensation occurs remarkably, spinnability of the pitch is excellent (i.e., thread breakage frequency is low, and the thread is thin and uniform), and also that since there is no change in quality during spinning, the quality of the product fiber material is stable; (3) that since there is virtually no generation of decomposed gas or formation of infusibles during spinning, high speed spinning is possible and the spun pitch fiber is almost flawless, and thus that the strength of the carbon fiber is enhanced; (4) that since the optically anisotropic pitch virtually comprising a nearly entirely liquid crystal form can be spun into a carbon fiber, a carbon fiber in which the orientation of the graphite structure in the fiber axis direction is well developed and whose modulus is high may be obtained; and so forth. When the optically anisotropic pitch was actually made into a carbon fiber in conventional manner, it has been found that a high strength, high modulus carbon fiber is stably obtained. In other words, the adequately homogeneous, optically anisotropic pitch (containing 80–100% of the AP) obtained by the process of the present invention may be melt spun at a temperature of 370° C. or below in conventional manner with reduced thread breakage frequency, may be taken off at a high speed, and can afford a thin fiber of e.g. 5–10μ in fiber diameter.

Furthermore, the pitch fiber obtained from the optically anisotropic pitch produced by the process of the present invention is made infusible in an oxygen atmosphere at a temperature of 200° C. or higher for 10 minutes to 2 hours or so, the pitch fiber thus made infusible is then carbonized by heating; for example, although the characteristics imparted depend on the fiber diameter, the carbon fiber obtained by carbonizing at 1300° C. have a tensile strength of $2.0–3.7\times10^9$ Pa and a tensile modulus of $1.5–3.0\times10^{11}$ Pa and the carbon fiber obtained by carbonizing at 1500° C. have a tensile strength of $2.0–4.0\times10^9$ Pa and a tensile modulus of $2.0–4.0\times10^{11}$ Pa.

EXAMPLE 1

A residual pitch obtained by subjecting a tarry material by-produced from catalytic cracking of petroleum to distillation under reduced pressure up to 540° C. (as converted to the normal pressure basis) was employed as a starting material.

The characteristic values of the starting material were as follows: a carbon content of 92.2 wt.%, a hydrogen content of 6.5 wt.%, a specific gravity of 1.22, a quinoline insoluble content of 0%, a Component O content of 51%, whose fa was 0.85, whose number average molecular weight was 319 and whose maximum molecular weight was 920, a Component A content of 49%, whose fa was 0.91, whose number average molecular weight was 375 and whose maximum molecular weight was 1,400, and a Component B content of 0.1 wt.% or less.

One thousand grams of this starting material oil was charged into a 1.45 liter heat treatment vessel and heat treated at 430° C. under nitrogen gas stream for 3 hours while sufficiently stirring to obtain a pitch having a softening point of 234° C., a specific gravity of 1.33 and a quinoline insoluble content of 15 wt.%, and containing about 45% of AP globules of 200μ or less in diameter in the optically isotropic matrix when observed on a polarizing microscope, at a yield of 34.5% based on the starting material.

This pitch was taken into a cylindrical reactor of 4 cm in inner diameter and 70 cm in length and equipped with a withdrawing cock in the lower part, and was maintained at 380° C. in a nitrogen atmosphere for 2 hours while stirring at 30 r.p.m. Then, the cock in the lower part of the reactor was opened under nitrogen pressure at 100 mm Hg or less, the slightly viscous lower layer pitch amounting to 29.4 wt.% was carefully withdrawn, then an additional portion was withdrawn until the pitch viscosity remarkably dropped to obtain the two-layer boundary pitch, and further the less viscous upper layer pitch amounting to 62.8 wt.% was withdrawn. The upper layer pitch was an optically isotropic pitch containing about 25% of optically anisotropic globules of 20μ or less in diameter and had a softening point of 207° C., a specific gravity of 1.32 and a quinoline insoluble content of 6 wt.%. The boundary pitch was a heterogeneous pitch in which an IP containing optically anisotropic globules of 20μ or less in diameter and a bulk AP were present complicatedly in mixture in the matrix. The lower pitch comprised 95% or more of the AP, and had a softening point of 265° C., a specific gravity of 1.35, a quinoline insoluble content of 35 wt.%, a carbon content of 94.5% and a hydrogen content of 4.4%. This pitch was used in Example 7 as Sample 1.

EXAMPLE 2

For comparison, a pitch obtained by subjecting a tarry material by-produced from naphtha pyrolysis to distillation under reduced pressure up to 540° C. was employed as a starting material. The characteristic values of the starting material were as follows: a carbon content of 92.5 wt.%, a hydrogen content of 7.3 wt.%, a specific gravity of 1.23, a quinoline insoluble content of 0%, a Component O content of 15 wt.%, whose fa was 0.79, whose number average molecular weight was 675 and whose maximum molecular weight was 1,500, a Component A content of 85 wt.%, whose fa was 0.83, whose number average molecular weight was 830 and whose maximum molecular weight was 15,000, and a Component B content of 0%.

Using the same heat treatment vessel as in Example 1, this starting material oil was heat treated at 415° C. at normal pressure under nitrogen gas stream for 3 hours while sufficiently stirring to obtain a pitch, which still remained complete IP, when observed on a polarizing microscope, and had a quinoline insoluble content of 0% and a softening point of 277° C. The yield of the pitch was 42.7 wt.% based on the starting material. Further, a pitch obtained by similarly heat treating at 415° C. for 4 hours was a pitch containing about 10% of AP globules of 20μ or less in diameter in the matrix when observed on a polarizing microscope and had a quinoline insoluble content of 11 wt.%. Its softening point was already 328° C. and the yield of the pitch was 36.8 wt.% based on the starting material. This was used in Example 7 as Sample 2.

EXAMPLE 3

For further comparison, a residual oil obtained by subjecting Minas crude oil to distillation under reduced pressure up to 540° C. (as converted to the normal pressure basis) was employed as a starting material. The characteristic values of the starting material were as follows: a carbon content of 87.3 wt.%, a hydrogen content of 12.3 wt.%, a specific gravity of 0.95, a quinoline insoluble content of 0%, a Component O content of 96 wt.%, whose fa was 0.18, whose number average molecular weight was 870 and whose maximum molecular weight was 1,750, a Component A content of 4 wt., whose fa was 0.46, whose number average molecular weight was 3,560 and whose maximum molecular weight was 58,000, and a Component B content of 0.1% or less.

This starting material oil was heat treated at 430° C. for 3 hours in the same manner as in Example 1, allowed to cool, and when the formed pitch was removed from the heat treatment vessel, it exhibited a two-layer appearance although the boundary was not clear. The yields of the two layers based on the starting material were 6.5 wt.% for the upper layer and 12.3 wt.% for the lower layer. When the upper layer was observed on a polarizing microscope, it was an optically isotropic pitch containing about 10% AP globules of 50μ or less in diameter in the optically isotropic matrix. On the other hand, the lower layer pitch, when observed on a polarizing microscope, was a heterogeneous pitch in which almost equal amounts of an IP and an AP were present complicatedly in mixture, and had a quinoline insoluble content of 55 wt.%. Its softening point was already 396° C., and spinning of this lower layer pitch was very difficult at any temperature.

EXAMPLE 4

One thousand grams of the starting material same as that in Example 1 was charged into a heat treatment vessel and heat treated at 430° C. under normal pressure under nitrogen gas stream for 4 hours while sufficiently stirring. This pitch obtained by the heat treatment alone had a softening point of 295° C. and a quinoline insoluble content of 32 wt.%, and, when observed on a polarizing microscope, about 80% thereof was an AP, and its yield was 27.4 wt.% based on the starting material. Further, a pitch obtained by similarly heat treating at 430° C. for 4.7 hours had a softening point of 316° C. and a quinoline insoluble content of 44 wt.%, and when observed on a polarizing microscope, 99% or more thereof was an AP, and its yield was 22.8 wt.% based on the starting material. These two pitches were able to be easily spun at a spinning temperature of 360°–370° C.

EXAMPLE 5

A tarry material by-produced from petroleum catalytic cracking was pyrolyzed at a still-bottom temperature of about 400° C. under reduced pressure, and distilled under reduced pressure up to 540° C. as converted to the normal pressure basis, to obtain an isotropic residue, which was employed as a starting material. The characteristic value of the starting materials were as follows: a carbon content of 93.3 wt.%, a hydrogen content of 5.4 wt.%, a specific gravity of 1.25, a quinoline insoluble content of 0.1 wt.% or less, a Component O content of 52 wt.%, whose fa was 0.78, whose number average molecular weight was 378 and whose maximum molecular weight was 1,830, a Component A content of 31 wt.%, whose fa was 0.82, whose number average molecular weight was 615 and whose maximum molecular weight was 3,250, and a Component B content of 17 wt.%, whose fa was 0.86, whose estimated number average molecular weight was 1,140 and whose estimated maximum molecular weight was 4,500.

One thousand grams of this starting material pitch was heat treated at 430° C. for 2.5 hours in the same manner as in Example 1. A pitch having a softening point of 229° C. and quinoline insoluble content of 19 wt.%, and containing about 40% of pearly AP globules of 200μ or less in diameter in the optically isotropic matrix when observed on a polarizing microscope was obtained at a yield of 41.8 wt% based on the starting material oil. This pitch was maintained at 380° C. for an hour in the same manner as in Example 1, and from the lower cock of the reactor, the slightly viscous lower layer pitch was withdrawn in an amount of 27.5 wt% based on the amount charged. This lower layer pitch was a pitch about 70% of which was optically anisotropic, and its softening point was 274° C. This pitch was further heat treated at 400° C. for an hour, to obtain a pitch about 95% or more of which was optically anisotropic and having a softening point of 283° C., a specific gravity of 1.36 and a quinoline insoluble content of 44 wt%. This pitch was used in Example 7 as Sample 3.

One thousand grams of the same starting material pitch as above was heat treated at 430° C. under normal pressure under nitrogen gas stream for 3.8 hours while sufficiently stirring in the heat treatment vessel same as that used in Example 1, thereby a pitch almost of which was optically anisotropic was produced by such heat treatment alone, at a yield of 32.6 wt% based on the starting material. When this pitch was observed on a polarizing microscope, it was found to be a pitch 98% of which was optically anisotropic, and it had a softening point of 307° C., a specific gravity of 1.36 and a quinoline insoluble content of 51 wt%. This pitch was used in Example 7 as Sample 4.

EXAMPLE 6

For comparison, a phenol extracted oil chiefly comprising those having a boiling point of 540° C. or higher and obtained as by-products from the step of producing lubricating oil from petroleum was employed as a starting material. The characteristic values of the starting material oil were as follows: a carbon content of 85.4 wt%, a hydrogen content of 11.4 wt%, a specific gravity of 0.96, and a Component O content of 100%, whose fa was 0.33, whose number average molecular weight was 640 and whose maximum molecular weight was 2,100.

A pitch obtained by heat treating 1,000 g of the above starting material oil at 415° C. for 4 hours in the same manner as in Example 1 had a softening point of 280° C. and a quinoline insoluble content of 0 wt%, and, when observed on a polarizing microscope, it was still a 100% optically isotropic pitch, the yield of which was 18.0 wt% based on the starting material.

Similarly, a pitch was obtained by heat treating the same at 415° C. for 5.5 hours, and this was found by observation on a polarizing microscope to be a heterogeneous pitch in which about 70% of an IP and about 30% of an AP were present complicatedly in mixture, it had a quinoline insoluble content of 32 wt%, its softening point reached 347° C., and its yield was 3.4 wt%.

Separately, a mixed oil was prepared by mixing 40 wt% of the above starting material oil with the starting material tar used in Example 1, and its characteristic values were as follows: a carbon content of 89.5 wt%, a hydrogen content of 7.5 wt%, a specific gravity of 1.11, a quinoline insoluble content of 0%, a Component O content of 71 wt%, whose fa was 0.64, whose number average molecular weight was 451 and whose maximum molecular weight was 2,050, and a component A content of 29 wt%, whose fa was 0.91, whose number average molecular weight was 370 and whose maximum molecular weight was 1,400. One thousand grams of this mixed starting material was heat treated at 430° C. for 3 hours in the same manner as in Example 1. Thus, there was obtained a pitch having a softening point of 231° C. and a quinoline insoluble content of 21 wt% and containing about 35 wt% based on the pitch of an AP, which was present as pearly AP globules of 100μ or less together with oval agglomerates of about 100μ in the optically anisotropic matrix when observed on a polarizing microscope, at a yield of 29.5 wt% based on the starting material. This pitch was maintained at 380° C. for 2 hours in the same manner as in Example 1, and the lower cock of the reactor was opened to withdraw the considerably viscous lower layer pitch at a rate of 23.9 wt% based on the amount charged. This lower layer pitch was that containing about 85% of the AP together with about 15% of an irregular oval IP part of 300μ or less within this AP, and had a softening point of 346° C. and a quinoline insoluble content of 54 wt%. This lower layer pitch was used in Example 7 as Sample 5.

Further, a mixed oil was prepared similarly by mixing 20 wt% of this phenol extracted oil into the starting material oil of Example 1, and its characteristic values were as follows: a carbon content of 90.8 wt%, a hydrogen content of 7.5 wt%, a quinoline insoluble content of 0%, a Component O content of 60 wt%, whose fa was 0.71, whose number average molecular weight was 385 and whose maximum molecular weight was 1,950, and a Component A content of 40 wt%, whose fa was 0.89, whose number average molecular weight was 375 and whose maximum molecular weight was 1,400. One thousand grams of this mixed starting material was heat treated at 430° C. for 2–3 hours in the same manner as in Example 1, thereby obtaining a pitch having a softening point of 217° C. and a quinoline insoluble content of 18 wt% and containing about 40 wt% of pearly AP globules of 200μ or less in the optically isotropic matrix when observed on a polarizing microscope, at a yield of 28.6 wt% based on the starting material. This pitch was maintained at 380° C. for 2 hours in the same manner as in Example 1, and the lower cock of the reactor was opened to withdraw the slightly viscous lower layer pitch at a rate of 27.4 wt% based on the amount charged. This lower layer pitch was nearly 100% optically anisotropic pitch having a large flow structure and having a softening point of 279° C. and a quinoline insoluble content of 39 wt%. This lower layer pitch was used in Example 7 as Sample 6.

EXAMPLE 7

When the respective samples obtained in Examples 1–6 were spun using a spinning machine having a nozzle of 0.5 mm in diameter under nitrogen pressure of 200 mm Hg or below, Samples 1, 3, 4 and 6 gave pitch fibers having a thin fiber thickness at a speed of 500 m/min stably for a prolonged time during which thread breakage frequency was low and change in quality of the pitch being spun was also small, whereas Samples 2 and 5 could not be spun at 500 m/min even by raising the spinning temperature, and even at 300 m/min, thread breakage frequency was high and a pitch fiber having a thin fiber thickness could not be obtained. Moreover, Samples 2 and 5 exhibited remarkable change in quality of the pitch presumably due to the pyrolytic polycondensation during spinning.

These pitch fibers obtained by spinning the respective pitches were then treated to be made infusible at 230° C. in a oxygen atmosphere for 30 minutes, heated to 1,500° C. at a rate of 30° C. per minute in an inert gas, and then cooled to obtain carbon fibers respectively.

The results of evaluation of the spinning and carbon fiber characteristics are summarized in Table 1.

TABLE 1

SPINNING AND CARBON FIBER CHARACTERISTICS OF OPTICALLY ANISOTROPIC PITCHES

| | Pitch Properties before Spinning | | Spinning Conditions | | | Thread Breakage Frequency | Pitch Properties after Spinning | | Carbon Fiber Characteristics (Carbonized at 1500° C. Average of 16 Samples) | | |
|---|---|---|---|---|---|---|---|---|---|---|---|
| Sample Pitch No. | Soft. Pt. (°C.) | Quinoline Insoluble (wt %) | Temp. (°C.) | Velocity (m/min) | Time (min) | (time/ 10 min) | Soft. Pt. (°C.) | Quinoline Insoluble (wt %) | Thickness ( ) | Tensile Strength (GPa) | Tensile Modulus (10 GPa) |
| 1 | 265 | 35 | 350 | 500 | 10 | Less than 1 | — | — | 8.1 | 3.9 | 3.5 |
| (Present | | | | | 60 | " | — | — | 7.6 | 4.0 | 3.8 |
| Invention) | | | | | 180 | " | 266 | 35 | 8.9 | 3.5 | 3.1 |
| 3 | 283 | 44 | 365 | 500 | 10 | Less than 1 | — | — | 8.8 | 3.2 | 2.8 |
| (Present | | | | | 60 | " | — | — | 8.8 | 3.4 | 3.1 |
| Invention) | | | | | 120 | " | 295 | 46 | 9.9 | 2.8 | 2.5 |
| 4 | 307 | 51 | 380 | 500 | 10 | Less than 1 | — | — | 9.5 | 3.1 | 2.7 |
| (Present | | | | | 60 | " | — | — | 8.9 | 2.8 | 2.3 |
| Invention) | | | | | 120 | 2 | 312 | 54 | 10.2 | 2.4 | 2.1 |
| 6 | 279 | 39 | 360 | 500 | 10 | Less than 1 | — | — | 7.8 | 3.8 | 3.3 |
| (Present | | | | | 60 | " | — | — | 8.4 | 3.6 | 3.3 |
| Invention) | | | | | 120 | " | 280 | 40 | 9.1 | 3.1 | 2.8 |

TABLE 1-continued

SPINNING AND CARBON FIBER CHARACTERISTICS OF OPTICALLY ANISOTROPIC PITCHES

| Sample Pitch No. | Pitch Properties before Spinning: Soft. Pt. (°C.) | Pitch Properties before Spinning: Quinoline Insoluble (wt %) | Spinning Conditions: Temp. (°C.) | Spinning Conditions: Velocity (m/min) | Spinning Conditions: Time (min) | Thread Breakage Frequency (time/10 min) | Pitch Properties after Spinning: Soft. Pt. (°C.) | Pitch Properties after Spinning: Quinoline Insoluble (wt %) | Carbon Fiber Characteristics (Carbonized at 1500° C. Average of 16 Samples): Thickness ( ) | Carbon Fiber Characteristics: Tensile Strength (GPa) | Carbon Fiber Characteristics: Tensile Modulus (10 GPa) |
|---|---|---|---|---|---|---|---|---|---|---|---|
| 2 (Comparative) | 328 | 11 | 395 | 300 | 10 | 7 | — | — | 12.6 | 1.0 | 0.7 |
| | | | | | 60 | More than 20 | 338 | 14 | 14.8 | 0.8 | 0.6 |
| 5 (Comparative) | 346 | 54 | 410 | 300 | 10 | More than 20 | — | — | 14.9 | 1.1 | 1.1 |
| | | | | | 60 | " | 358 | 57 | 18.1 | 0.9 | 0.8 |

Thus, as clear from the results of the above table, etc., according to the present invention, a low softening point, optically anisotropic pitch substantially comprising a homogeneous AP may be obtained in a short time without the need of a complicated and costly step, such as high temperature filtration or solvent extraction of the infusibles, or addition and removal of the catalyst, etc.

By using such a pitch of the present invention, since it has a low softening point and homogeneity, spinning is possible at a temperature sufficiently lower than 400° C. at which remarkable pyrolytic polycondensation occurs, and also its spinnability is excellent (i.e. thread breakage frequency is low and the thread is thin and uniform), and further since there is no change in quality during spinning, the quality of the carbon fiber as the product is also stable.

Furthermore, by using the pitch of the present invention, since there is virtually no generation of decomposed gas or formation of infusibles during spinning, the spun pitch fiber is almost free from defects (formation of bubbles and inclusion of solid extraneous matters), and as a result, a high strength carbon fiber can be obtained. In addition, since the pitch of the present invention is an optically anisotropic pitch most of which is a liquid crystal form, a carbon fiber having orientation of a graphite structure well developed in the fiber axis direction and a high modulus can be obtained.

What is claimed is:

1. A homogeneous, low softening point, optically anisotropic pitch containing approximately 80% or more of an optically anisotropic phase and a softening point of approximately 320° C. or below, said pitch prepared by:

(1) providing a pitch-like material comprising a mixture of compounds consisting of carbon and hydrogen and having an approximate boiling point of 540° C. or higher, said mixture being substantially free from quinoline insolubles, said mixture containing a first component soluble in n-heptane and a second component insoluble in n-heptane and soluble in benzene, each aromatic carbon fraction of such components being about 0.7 or higher, each number average molecular weight being about 1,500 or less, and each maximum molecular weight being approximately 10,000 or less;

(2) heating said pitch-like material at temperatures in the range of from about 380° C. to about 440° C. for a time sufficient to form about 20% to about 70% of an optically anisotropic phase;

(3) maintaining said heated pitch-like material at temperatures in the range of from about 350° C. to about 400° C. for a time sufficient for said heated pitch material to form an upper layer and a lower layer;

(4) separating said lower layer from said upper layer; and (5) heating said lower layer at a temperature in the range of from about 380° C. to about 440° C. for a time sufficient to increase the optical anisotropic phase content of said separated lower layer to 80% or more.

2. The pitch-like material of claim 1, further including a third component insoluble in benzene and soluble in quinoline.

3. The pitch-like material of claim 2, wherein each aromatic carbon fraction of said first component, said second component and said third component is about 0.75 or higher.

4. The pitch-like material of claim 1, wherein each number average molecular weight of said first Component and said second Component is between 250 and 900, and each maximum molecular weight is 3,000 or less.

5. The pitch-like material of claim 3, wherein the aromatic carbon fraction of the third component is approximately 0.8 or higher, its number average molecular weight is approximately between 500 and 1,200 and its maximum molecular weight is approximately 5,000 or less.

6. The pitch of claim 1, wherein the softening point of said optically anisotropic pitch is in the approximate range of between 230° and 320° and the content of the optically anisotropic phase therein is in the approximate range of between 90 and 100%.

7. The pitch of claim 6, wherein said pitch-like material is heated under normal pressure while passing or bubbling inert gas and simultaneously removing low molecular weight substances.

8. The pitch of claim 6, wherein said pitch-like material is heated under normal pressure and thereafter low molecular weight substances are removed by distillation under reduced pressure or inert gas stripping treatment.

9. The pitch of claim 6, wherein said pitch-like material is heated under elevated pressure and thereafter distillating under reduced pressure or stripping treatment with an inert gas.

10. The pitch of claim 6, wherein said pitch-like material is heated while simultaneously separating the optically anisotrpic phase being formed.

11. A process for producing a homogeneous, low softening point, optically anisotropic pitch containing approximately 80% or more of an optically anisotropic phase and a softening point of approximately 320° C. or below, comprising the steps of: (a) pyrolytically polycondensing a pitch-like material which is a mixture comprising compounds consisting of carbon and hydrogen and having a boiling point of approximately 540° C. or higher and is substantially free from quinoline insolubles, said pitch-like material containing a first Component soluble in n-heptane, and a second Component insoluble in n-haptane and soluble in benzene, an aromatic carbon fraction of each component being approximately 0.7 or higher, each number average molecular weight being approximately 1,500 or less, and each maximum molecular weight being approximately 10,000 or less, said pyrolytically polycondensing said pitch-like material being achieved by heating the said pitch-like material at a temperature in the range of about 380° C. to 440° C. until the content of pyrolytically polycondensed pitch-like material has an optically anisotropic phase of between approximately 20 and 70%, (b) thereafter maintaining said pitch-like material at a temperature in the approximate range of between 350° and 400° C. to form an upper layer and a lower layer, said lower layer being rich in the optically anisotropic phase; (c) separating the lower layer; and (d) heating said separated lower layer at temperatures in the range of about 380° C. to about 400° C. for a time sufficient to increase the optically anisotropic phase of said lower layer to greater than about 80%.

12. The process of claim 11, wherein the pitch-like-material further comprises a third component insoluble in benzene and soluble in quinoline.

13. The process of claim 11, wherein each aromatic carbon fraction of said components is approximately 0.75 or higher.

14. The process of claim 12, wherein each number average molecular weight of said first Component and said third Component is approximately between 250 and 900 and each maximum moleculr weight is approximately 3,000 or less.

15. The process of claim 11, wherein the aromatic carbon fraction of said second Component is approximately 0.8 or higher, its number average molecular weight is approximately between 500 and 1,200 and its maximum molecular weight is approximately 5,000 or less.

* * * * *